United States Patent [19]

Cooke, Jr.

[11] 4,407,365

[45] Oct. 4, 1983

[54] METHOD FOR PREVENTING ANNULAR FLUID FLOW

[75] Inventor: Claude E. Cooke, Jr., Houston, Tex.

[73] Assignee: Exxon Production Research Co., Houston, Tex.

[21] Appl. No.: 297,375

[22] Filed: Aug. 28, 1981

[51] Int. Cl.[3] ..... E21B 43/00; E21B 33/14

[52] U.S. Cl. ..... 166/249; 166/286; 166/299

[58] Field of Search ..... 166/249, 286, 299, 63, 166/177, 285, 281

[56] References Cited

U.S. PATENT DOCUMENTS

| | | | |
|---|---|---|---|
| 2,796,131 | 6/1957 | Hinchliffe et al. | 166/281 |
| 2,915,122 | 12/1959 | Hulse | 166/249 |
| 3,239,005 | 3/1966 | Bodine, Jr. | 166/286 |
| 3,335,801 | 12/1964 | Wilsey | 166/177 |
| 3,376,921 | 4/1968 | Manry et al. | 166/4 |
| 3,557,875 | 1/1971 | Solum et al. | 166/278 X |
| 3,654,991 | 4/1972 | Harnsberger et al. | 166/281 |
| 3,770,054 | 11/1973 | Solum | 166/177 |
| 4,074,756 | 2/1978 | Cooke, Jr. | 166/253 |
| 4,093,028 | 6/1978 | Brandon | 166/281 |
| 4,120,360 | 10/1978 | Messenger | 166/293 |
| 4,305,463 | 12/1981 | Zakiewicz | 166/281 X |
| 4,312,405 | 1/1982 | Wilder | 166/285 |

OTHER PUBLICATIONS

Walther, E., "Dual Casing Motion Improves Cement Bond", *Well Servicing*, Nov./Dec. 1980, pp. 39 and 40.

Lindsey, H. E., "Recent Developments in Tools for Liner Movement During Cementation", Southwestern Petroleum Short Course, 1981, pp. 47–54.

Martinez et al., "Study of Cementing Practices Applied to the Shallow Casing in Offshore Wells", Oct. 1980.

"Recommended Procedure for the Use of Reversible Scratchers and Spiral Centralizers", Weatherford Oil Tool Co., Inc., Technical Bulletin published in the Journal of Petroleum Technology, Sep., 1956.

Carter, G. and Slagle, K., "A Study of Completion Practices to Minimize Gas Communication", Paper SPE 3164, presented at the Central Plains Regional Meeting of the Society of Petroleum Engineers of AIME held in Amarillo, Texas, Nov. 16–17, 1970.

Levine, D. C. et al., "Annular Gas Flow After Cementing: A Look at Practical Solutions", Paper SPE 8255, presented at the 54th Annual Fall Technical Conference and Exhibition of the Society of Petroleum Engineers of AIME held in Las Vegas, Nevada, Sep. 23–26, 1979.

Tinsley, J. M. et al., "Study of Factors Causing Annular Gas Flow Following Primary Cementing", Paper SPE 8257, presented at the 54th Annual Fall Technical Conference and Exhibition of the Society of Petroleum Engineers of AIME held in Las Vegas, Nevada, Sep. 23–26, 1979.

Webster, W. W. et al., "Flow After Cementing–A Field and Laboratory Study", Paper SPE 8259, presented at the 54th Annual Fall Technical Conference and Exhibition of the Society of Petroleum Engineers of AIME held in Las Vegas, Nevada, Sep. 23–26, 1979.

Watters, L. T. et al., "Field Evaluation of Method to Control Gas Flow Following Cementing", Paper SPE 9287, presented at the 55th Annual Fall Technical Conference and Exhibition of the Society of Petroleum Engineers of AIME held in Dallas, Texas, Sep. 21–24, 1980.

Davis, D. R. et al., "An Integrated Approach for Successful Primary Cementations", Paper SPE 9599, presented at the Middle East Oil Technical Conference of the Society of Petroleum Engineers held in Manama, Bahrain, Mar. 9–12, 1981.

Christian, W. W. et al., "Gas Leakage in Primary Cementing–A Field Study and Laboratory Investigation", Journal of Petroleum Technology, Nov., 1976, pp. 1361–1369.

Cook, C. et al., "Filtrate Control–A Key in Successful Cementing Practices", Journal of Petroleum Technology, Aug. 1977, pp. 951–956.

Advertisment for Bowen Type Z Oil Jars from Composite Catalog of Oil Field Equipment and Services, 1981–1982, published by World Oil, Houston, Texas.

ASTM C 266, "Time of Setting of Hydraulic Cement by Gillmore Needles", published by the American Society for Testing and Materials, Philadelphia, Pennsylvania.

API Bulletin 10C, "Oil–Well Cement Nomenclature", published by the American Petroleum Institute, Dallas, Texas.

*Primary Examiner*—Ernest R. Purser
*Assistant Examiner*—Thuy M. Bui
*Attorney, Agent, or Firm*—Keith A. Bell

[57] ABSTRACT

A method for preventing annular fluid flow following primary cementing of oil and gas well casings is disclosed. Pursuant to said method the casing is vibrated so as to maintain the hydrostatic pressure of the cement column surrounding the casing at or above the pressure of the fluids in the various formations penetrated by the well until the cement has acquired its initial set. The vibration may be either continuous or intermittent. Preferably, the vibration has a low frequency. The method may include the additional step of applying pressure to the surface of the cemented annulus while the cement is curing. The vibration may be induced in several ways. For example, the casing may be vibrated by simultaneous or sequential explosions of a slow-burning black powder. Alternatively, hydraulic jars may be used to strike blows on the casing causing the casing to vibrate.

28 Claims, 9 Drawing Figures

PRIOR ART

PRIOR ART

METHOD FOR PREVENTING ANNULAR FLUID FLOW

FIELD OF THE INVENTION

This invention relates to the prevention of annular fluid flow following primary cementing of well casings. More particularly, the invention pertains to a method for primary cementing of well casings wherein the casing is vibrated so as to maintain the hydrostatic pressure of the cement slurry in the annulus between the casing and the wall of the wellbore at or above the pressure of the fluids in the various formations penetrated by the well until the cement has acquired sufficient strength to prevent formation fluids from entering the cemented annulus.

BACKGROUND OF THE INVENTION

Oil and gas wells may be several thousand feet deep and may pass through several different hydrocarbon producing formations. Additionally, fresh water formations may be traversed by the wellbore. It is important in the completion of such a well that each producing formation be isolated from all other producing formations and from fresh water formations and the surface. The need for zonal isolation also arises in other types of wells such as, for example, water source wells, storage wells, geothermal wells and injection wells. Typically, this isolation is accomplished by installing metallic tubulars in the wellbore which are joined by threaded connections and cemented in place. These metallic tubulars are typically referred to as "casing". The term "liner" is also used to refer to a string of casing whose top is located below the surface of the well. All such metallic tubulars will be referred to herein as "casing".

The process for primary cementing of a metallic casing is well known. During drilling operations the wellbore is filled with a drilling fluid. The hydrostatic pressure exerted by the drilling fluid on the walls of the wellbore prevents flow of formation fluids into the wellbore. After the well has been drilled to the desired depth the casing is inserted into the wellbore and a cement slurry is pumped down the casing and up the annular space between the casing and the wall of the wellbore thereby displacing the drilling fluid. If the cement extends to the surface all of the drilling fluid is normally displaced, except any which may be by-passed in a filter cake on the wall of the wellbore. Alternatively, if the cement does not extend to the surface some drilling fluid will remain in the annulus above the cement. Upon completion of the displacement process the combined hydrostatic pressure exerted by the drilling fluid, if any, and the cement slurry prevents formation fluids from entering the wellbore. When the cement cures, each producing formation should be permanently isolated thereby preventing fluid communication from one formation to another. The cemented casing may then be selectively perforated so as to produce fluids from a particular formation.

Unfortunately, however, a large percentage of well completions are unsuccessful or, at best, only partially successful in achieving total zonal isolation of the various producing formations penetrated by the well. This is especially true in deep well completions across relatively high pressure gas producing formations where gas flow to the surface through the cemented annulus is often observed soon after completion of the cementing. This phenomenon, known as annular fluid flow, is a major problem requiring expensive and technically difficult remedial measures. One such remedial measure is described in U.S. Pat. No. 4,074,756 to Cooke, Jr., issued Feb. 21, 1978. The term "annular gas flow" is also used in the literature to describe this problem. However, since the problem may occur with liquids as well as gases, the term "annular fluid flow" is more accurate.

Another example of annular fluid flow is observed when wells are drilled in areas where secondary or tertiary oil recovery operations are in progress. Such operations typically involve the injection of a fluid such as, for example, water, carbon dioxide, surfactants or methane so as to force the oil to flow toward the recovery wells. A new well in such an area may penetrate zones of widely different permeability and pressure. Flow of the injected fluids behind the well casing, caused by lack of zonal isolation, is a major problem in these areas. Although such flow usually does not occur to the surface, flow between subterranean formations is often found.

The problem of annular fluid flow was first recognized in the mid 1960's. See, for example, Carter G. and Slagle K., "A Study of Completion Practices to Minimize Gas Communication", Paper SPE 3164, presented at the Central Plains Regional Meeting of the Society of Petroleum Engineers of AIME held in Amarillo, Texas, Nov. 16–17, 1970. A great deal of time and effort has been expended seeking a solution to this long-standing problem. No completely satisfactory solution has yet been proposed.

The failure mechanism which results in annular fluid flow is probably very complex with a number of different factors combining to produce the failure. Several different theories have been advanced to explain annular fluid flow, and a number of potential solutions have been proposed. One theory suggests that annular fluid flow occurs when the cement slurry fails to uniformly displace the drilling fluid from all parts of the annulus. This results in the presence of longitudinal channels of gelled drilling fluid in or next to the cement sheath which provide paths for fluid communication between the various formations penetrated by the well. One proposed solution for this problem is the use of pipe movement during the displacement process. Pursuant to this solution scratchers are attached to the outside of the casing being cemented and the casing is slowly raised and lowered while the cement is being pumped into the annulus. Typically, the casing is moved vertically for a distance of several feet with movements of up to 30 feet being common. The movement of the scratchers helps to dislodge any gelled drilling fluid which may be adhering to the wall of the wellbore thereby facilitating total displacement of the drilling fluid by the cement slurry. See, for example, "Recommended Procedure For the Use of Reversible Scratchers and Spiral Centralizers", Weatherford Oil Tool Co., Inc., Technical Bulletin published in the *Journal of Petroleum Technology*, September, 1956. Typically, the pipe movement is terminated upon completion of the displacement process and the cement slurry is allowed to harden undisturbed. In some cases the pipe movement may be continued for a few minutes after completion of the displacement process so as to mix any remaining drilling fluid into the cement slurry. Such movement must be terminated when increased drag on the pipe indicates that the cement has begun to thicken.

A second theory suggests that annular fluid flow occurs due to a reduction in the hydrostatic pressure exerted by the cement column during its initial hydration period. During pumping the cement slurry behaves as a liquid and fully transmits hydrostatic pressure. Thus, immediately after the cement is pumped into the annulus the hydrostatic pressure in the cement column is typically considerably greater than the pressure of the fluids in the various producing formations. If, however, the hydrostatic pressure of the cement column drops below the pressure of the formation fluids, the fluids will flow into the cemented annulus creating channels which permit communication between the various formations. Under this theory the reduction in hydrostatic pressure is attributed to a variety of factors such as excessive cement dehydration, cement shrinkage and nonuniform cement hydration. See, Levine, D. C., et al., "Annular Gas Flow After Cementing: A Look at Practical Solutions", Paper SPE 8255, presented at the 54th Annual Fall Technical Conference and Exhibition of the Society of Petroleum Engineers of AIME held in Las Vegas, Neveda, Sept. 23–26, 1979. Levine, et al., propose the use of techniques such as adjusting the height of the cement column, varying the thickening time of the cement slurry, applying surface pressure to the cemented annulus, increasing the drilling fluid density, increasing the mix water density, utilizing multiple stage cementing procedures and utilizing modified cement slurries. Each of these proposed techniques is applicable only in certain specific situations and it is difficult to predict the results for a specific application. Use of such techniques may be of some help; however, they do not provide an adequate solution to the problem.

Another explanation for the reduction in hydrostatic pressure is discussed in U.S. Pat. No. 4,120,360 to Messenger, issued Oct. 17, 1978. Messenger contends that the reduction in hydrostatic pressure results from a separation of the cement slurry into water and discrete particles of cement, which particles then form a cement lattice and prevent the full hydrostatic pressure of the cement slurry from being transmitted down the annulus. Messenger proposes the use of a lightweight thixotropic cement slurry that has zero water separation to solve the problem of annular fluid flow.

Still another explanation for the reduction in hydrostatic pressure is presented in Davies, D. R., et al., "An Integrated Approach for Successful Primary Cementations", Paper SPE 9599, presented at the Middle East Oil Technical Conference of the Society of Petroleum Engineers held in Manama, Bahrain, Mar. 9–12, 1981. Davies, et al., suggest that hydrostatic pressure is lost due to a build-up of gel strength coupled with a simultaneous volume reduction caused by the cement hydration process and by fluid loss to permeable formations. Davies, et al., propose an integrated, total job design approach to primary cementing to solve the problem of annular fluid flow. This integrated approach involves the use of improved drilling practices, improved displacement procedures and a highly dilatant, thinned scavenger cement slurry to achieve good drilling fluid displacement.

Yet another proposed solution is discussed in Tinsley, J. M., et al., "Study of Factors Causing Annular Gas Flow Following Primary Cementing", Paper SPE 8257, presented at the 54th Annual Fall Technical Conference and Exhibition of the Society of Petroleum Engineers of AIME held in Las Vegas, Nevada, Sept. 23–26, 1979. Tinsley, et al., propose the use of a new, compressible cement system to solve the problem of annular fluid flow. The cement's compressibility and volume are increased by introducing a gaseous phase into a conventional cement slurry in the form of small, finely dispersed bubbles. The bubbles are generated by a chemical reaction in the cement. Field application of this proposed solution, however, requires a great deal more engineering design than conventional cementing systems. The amount of gas necessary to increase the cement's compressibility and volume must be calculated for each specific application and the rate of the chemical reaction which forms the bubbles must be controlled very carefully.

As stated above, pursuant to the present invention the casing is vibrated after the cement has been introduced into the annulus so as to maintain the hydrostatic pressure of the cement column above the pressure of the fluids in the formations penetrated by the well. Vibration has been used in the past for a variety of oil well related purposes. See, for example, U.S. Pat. No. 3,557,875 to Solum, et al., issued Jan. 26, 1971, which discloses the use of vibration to aid in the displacement process during primary cementing of casings. Pursuant to this process, the casing is vibrated while the cement is being pumped into the well so as to dislodge any gelled drilling fluid which may be adhering to the wall of the wellbore. Vibration is terminated upon completion of the displacement process and the cement is allowed to harden undisturbed. A second use for vibration is disclosed in U.S. Pat. No. 3,239,005 to Bodine, Jr., issued Mar. 8, 1966. Bodine uses resonant vibration to break the bond between a cement sheath and a smooth metallic mandrel inserted into the wellbore so that the mandrel can be removed after the cement has cured leaving only the cement sheath in the well. Thus, Bodine is not applicable to installation of standard metallic casings which utilize centralizers and scratchers attached to the outside of the casing and which have pipe collars on their ends for joining several sections together. These protuberances would prevent removal of the casing after the cement has cured. Additionally, Bodine is applicable only to relatively shallow wells. Oil and gas wells may be drilled to depths of 2 miles or more. Such wells are not vertically straight. Horizontal deviations of 100 feet or more from the projected centerline are common. In fact, some wells are intentionally deviated from vertical using known techniques for directional drilling. These horizontal deviations would prevent removal of the rigid mandrel disclosed by Bodine. Also, the surface vibrations of Bodine would be totally damped out within a few hundred feet of the surface leaving the majority of the cemented annulus undisturbed. Neither Solum et al. nor Bodine teach that vibration may be used to maintain the hydrostatic pressure in a cement column as it cures.

It is obvious from the foregoing that annular fluid flow is a significant, long-standing problem which, as yet, is not well understood. A great deal of time and effort has been expended seeking a solution to this problem. Several theories and possible solutions have been proposed. However, none of the proposed solutions is wholly satisfactory. Clearly, the need exists for a reliable, easy to use method for effectively preventing annular fluid flow following primary cementing of well casings.

SUMMARY OF THE INVENTION

Briefly, the present invention solves the problem of annular fluid flow by vibrating the casing so as to maintain the hydrostatic pressure of the cement column surrounding the casing at or above the pressure of the fluids in the various formations penetrated by the well. Typically, the vibration would commence after the cement slurry has been pumped into the annulus and continue until the cement has acquired sufficient strength to prevent pressurized formation fluids from entering the wellbore. Preferably, the vibration is continued until the cement has acquired its initial set. Generally, when the cement has acquired its initial set it has become non-thixotropic. This occurs substantially before the cement has fully cured or acquired its final set. Thereafter, further vibration will be ineffectual in maintaining the cement column's hydrostatic pressure. However, after acquiring its initial set, the cement column should have sufficient structural integrity and sufficiently low permeability to prevent fluid invasion. The vibration may be either continuous or intermittent and, preferably, has a low frequency. Additionally, the invention may include the step of applying pressure to the surface of the cemented annulus while the cement is curing. Typically, the pressure would be maintained until the cement has acquired its initial set. This will increase the overall hydrostatic pressure of the cement column.

A number of methods may be used to vibrate the casing. One such method uses explosive charges to generate pressure pulses which vibrate the casing. Preferably, a slow-burning explosive is used so as to maximize the low frequency portion of the resulting vibration. According to this method a plurality of explosive containers each having a plurality of explosive charges therein are lowered into the cemented annulus on a multiconductor cable. The vertical distance between the various explosive containers is dependent on the rate at which the vibratory energy attenuates due to the damping effect of the casing and the cement slurry. The explosive containers should be spaced so as to achieve vibration throughout a significant portion of the casing being cemented, although vibration over the entire cemented length may not be necessary. The charges are fired electronically from the surface. Each charge is wired so that it may be fired independently of the others. Typically, the first charge in each container is fired simultaneously thereby creating a plurality of pressure pulses at various depths in the casing. After a suitable time interval during which the cable may be raised or lowered in the well, the second charge of each container is fired simultaneously, thereby duplicating the above result. This process continues until all charges have been fired. Thus, the entire casing may be vibrated several times without need to recharge the containers.

A second method for vibrating the casing uses hydraulic jars to strike the casing. The hydraulic jars are attached to the lower end of a drill string and a specially designed locking head is attached to the hydraulic jar. When the jar has been properly positioned, pressure is applied to the locking head from the surface. The pressure is transmitted to the locking head through the drill string and the hydraulic jar. This causes a plurality of locking pins mounted in the locking head to extend and engage a retaining groove in the casing string. Upward force on the drill string then causes a piston in the jar to strike a mandrel thereby vibrating the casing. Relieving the upward tension resets the jar for another blow.

Other methods of vibrating the casing will be apparent to those skilled in the art. All such methods are encompassed within the scope of the present invention.

BRIEF DESCRIPTION OF THE DRAWINGS

In order to more fully understand the drawings used in the following detailed description of the present invention, a brief description of each drawing is provided.

FIG. 1A is a cross-sectional elevation view showing the first step of the displacement procedure.

FIG. 1B is a cross-sectional elevational view showing the second step of the displacement procedure.

FIG. 1C is a cross-sectional elevation view showing the final step of the displacement procedure.

FIG. 1D is a cross sectional elevation view showing the perforations used to produce hydrocarbons after the casing has been cemented.

DETAILED DESCRIPTION OF THE PREFERRED EMBODIMENT

As discussed above, the primary purpose for installing cemented metallic casings in a wellbore is to isolate each of the formations from all other formations penetrated by the well. Metallic well casings are of two principal types, surface casing and production casing. Several different sizes of casing may be used in some wells. Surface casing is the first casing installed in a wellbore and extends from the ground surface downwardly for a distance of from a few hundred feet to several thousand feet. Some states require that a minimum length of surface casing be installed in each well in order to isolate fresh water sands. Production casing is typically installed downhole adjacent the hydrocarbon formations to be produced. The outside diameter of the production casing must be slightly less than the inside diameter of the surface casing so that the production casing can be inserted into the wellbore through the surface casing. Typically, both surface casing and production casing are cemented in place, as will be more fully described below.

Figure 1A:
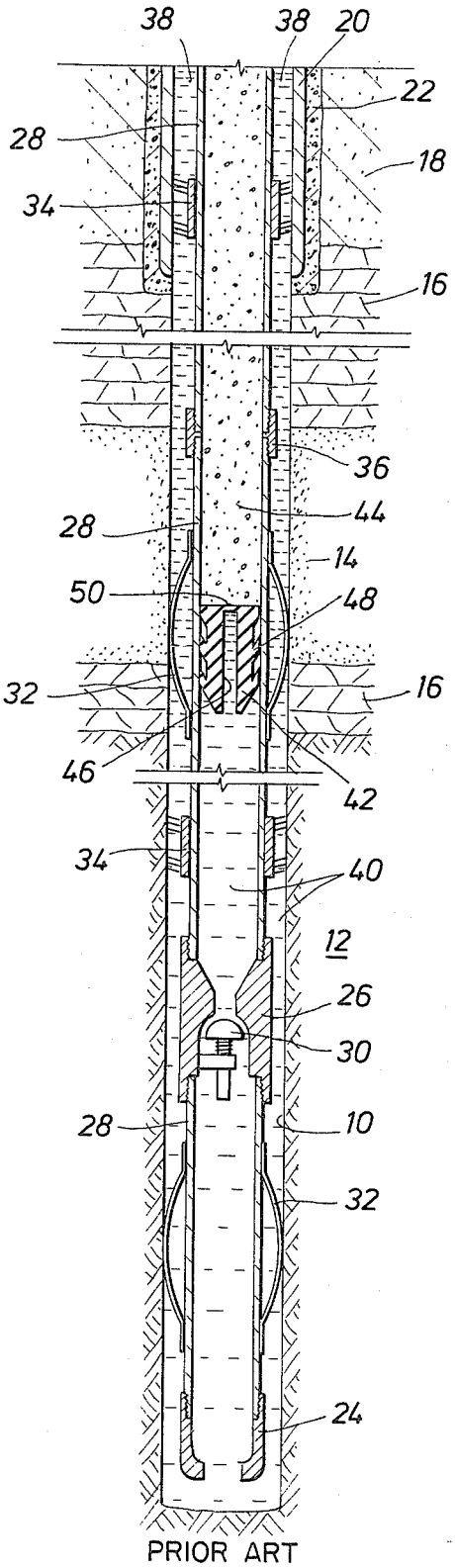
FIGS. 1A through 1D illustrate the various steps involved in a typical production casing primary cementing job.

FIGS. 1A through 1D illustrate the various steps involved in a typical production casing primary cementing job. It will be understood that the following discussion and the present invention are equally applicable to the cementing of surface casing and all other casing strings. Referring now to FIG. 1A, there is shown a wellbore 10 drilled into the earth 12 using conventional drilling means. The wellbore 10 passes through one or more hydrocarbon producing formations 14 and, typically, through one or more non-producing formations 16. Additionally, it is likely that the wellbore 10 will penetrate one or more layers of fresh water producing sands 18.

The well is first drilled to a depth sufficient to allow installation of surface casing 20 which is then cemented in place by forming a first cement sheath 22 around the casing. Cement sheath 22 is formed in essentially the same manner as will be hereinafter described.

After surface casing 20 has been installed, a smaller diameter drill bit is used to drill the wellbore to the desired final depth. After wellbore 10 has reached the desired final depth, a casing string consisting essentially of casing shoe 24, float collar 26 and a number of joints of steel production casing 28 is inserted into the wellbore 10. The purpose of casing shoe 24 is to prevent abrasion or distortion of the production casing as it forces its way past obstructions on the wall of the wellbore. Float collar 26 contains a back-pressure valve 30 which permits flow in the downward direction only. Typically, a plurality of casing centralizers 32 are attached at various points along the outer surface of the casing string so as to hold the casing string in the center of the wellbore. Additionally, a plurality of scratchers 34 may be attached to the outer surface of the casing string. Scratchers 34 are used during the displacement process in conjunction with reciprocation or rotation of the casing string to dislodge any gelled drilling fluid which may be adhering to the walls of wellbore 10. Typically, collar 36 is used to connect adjacent sections of production casing 28.

During insertion of the casing string into the wellbore 10, the annulus 38 between the casing string and the wall of the wellbore is filled with drilling fluid 40. The hydrostatic pressure exerted by drilling fluid 40 against hydrocarbon producing formation 14 prevents flow of hydrocarbon fluids from producing formation 14 into wellbore 10.

FIG. 1A illustrates the initial step in the displacement process. Bottom cementing plug 42 is inserted into the casing string and a cement slurry 44 is pumped into the casing string above bottom cementing plug 42. Bottom cementing plug 42 has a longitudinal hole 46 formed through its center, a plurality of annular wipers 48 formed along its outer surface and a diaphragm 50 attached to its top surface to prevent the flow of fluids through longitudinal hole 46. As the cement slurry 44 is pumped into the casing string it pushes bottom cementing plug 42 downwardly. This, in turn, forces drilling fluid 40 to flow downwardly through the casing string and then upwardly through annulus 38. Displaced drilling fluid is collected at the surface of the well (not shown). Back-pressure valve 30 is held open by the downward movement of drilling fluid 40.

Figure 1B:
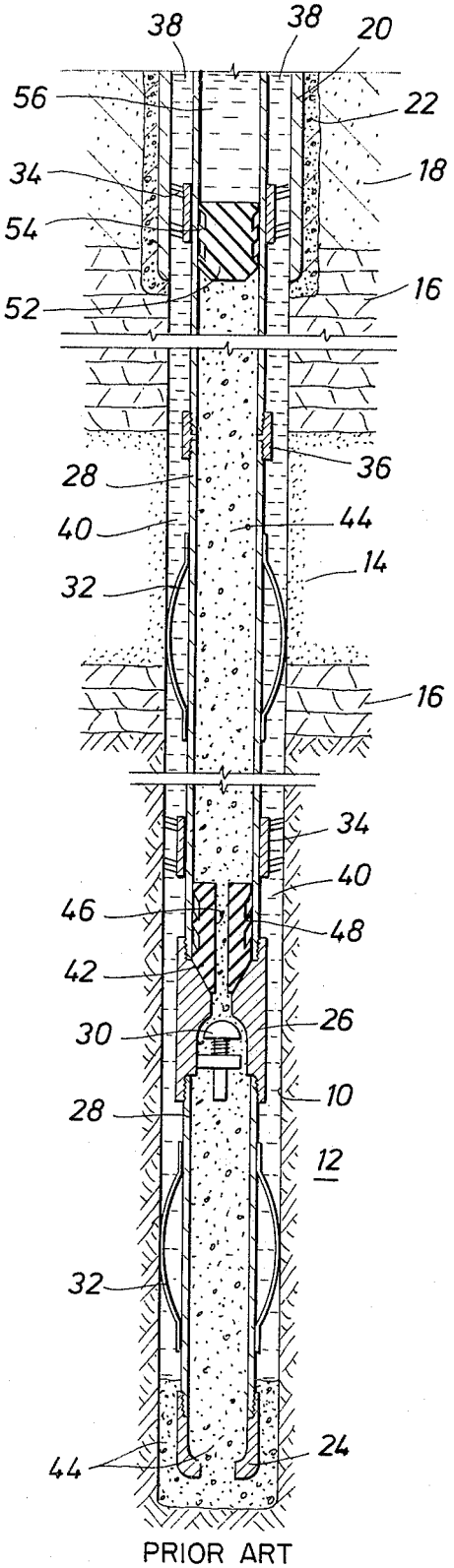
PRIOR ART FIG. 1B

The second step in the displacement process is illustrated in FIG. 1B. Bottom cementing plug 42 has been forced downwardly by cement slurry 44 into contact with float collar 26 thereby preventing further downward movement. Further pumping causes the pressure of cement slurry 44 to increase until diaphragm 50 (shown in FIG. 1A only) ruptures. This permits cement slurry 44 to flow downwardly through hole 46 in bottom cementing plug 42 and the remainder of the casing string and then upwardly into annulus 38. Back-pressure valve 30 is held open by the downward movement of cement slurry 44. As above, displaced drilling fluid is collected at the surface of the well. When the planned amount of cement slurry 44 has been pumped into the casing string, a top cementing plug 52 is inserted. Top cementing plug 52 has a plurality of annular wipers 54 formed along its outer surface. A displacement fluid 56 is then introduced into the casing string above top cementing plug 52 and pumped downwardly. Typically, displacement fluid 56 would be water.

Figure 1C:
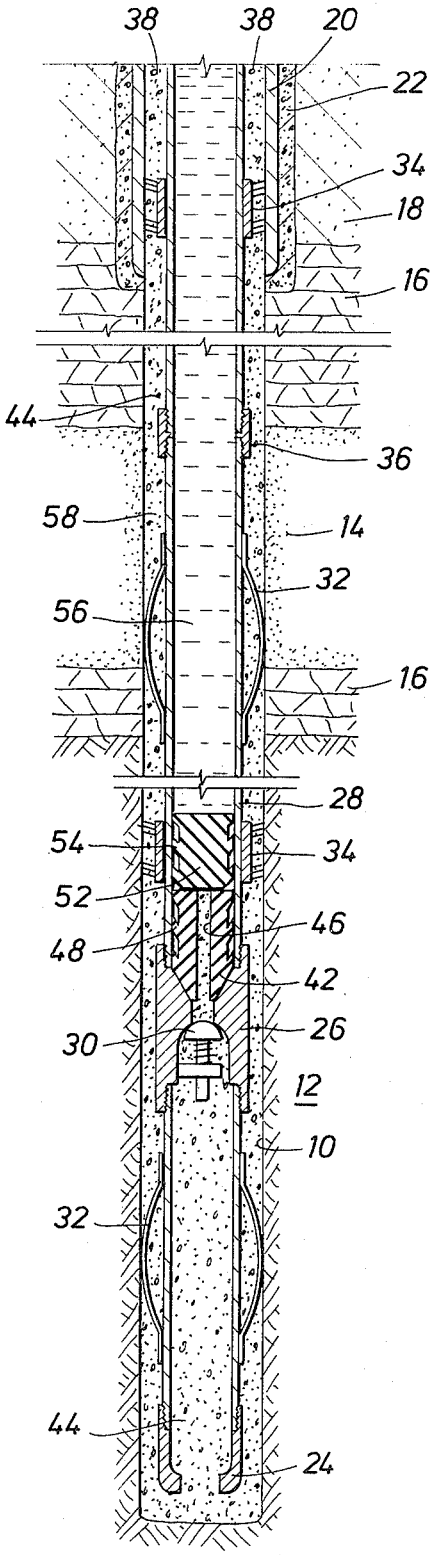

The final step of the displacement process is illustrated in FIG. 1C. Top cementing plug 52 has been forced downwardly by displacement fluid 56 into contact with bottom cementing plug 42 thereby shutting off further flow through longitudinal hole 46. Pumping is then terminated and the pressure in the casing above the top cementing plug 52 is released at the surface. Back-pressure valve 30 closes preventing the cement slurry 44 from flowing upwardly in the casing string due to the hydrostatic pressure of the cement slurry in the annulus 38. The cement slurry 44 in annulus 38 may extend to the surface of the well. Alternatively, some drilling fluid (not shown) may remain in annulus 38 above the cement slurry 44. The cement slurry 44 is then allowed to harden forming a second cement sheath 58 around the casing string. Upon hardening, the casing string is firmly locked in place by the bond between the cement sheath 58 and the casing string and by the mechanical locks provided by the various protuberances (casing shoe 24, float collar 26, casing centralizers 32, scratchers 34 and collars 36).

Figure 1D:
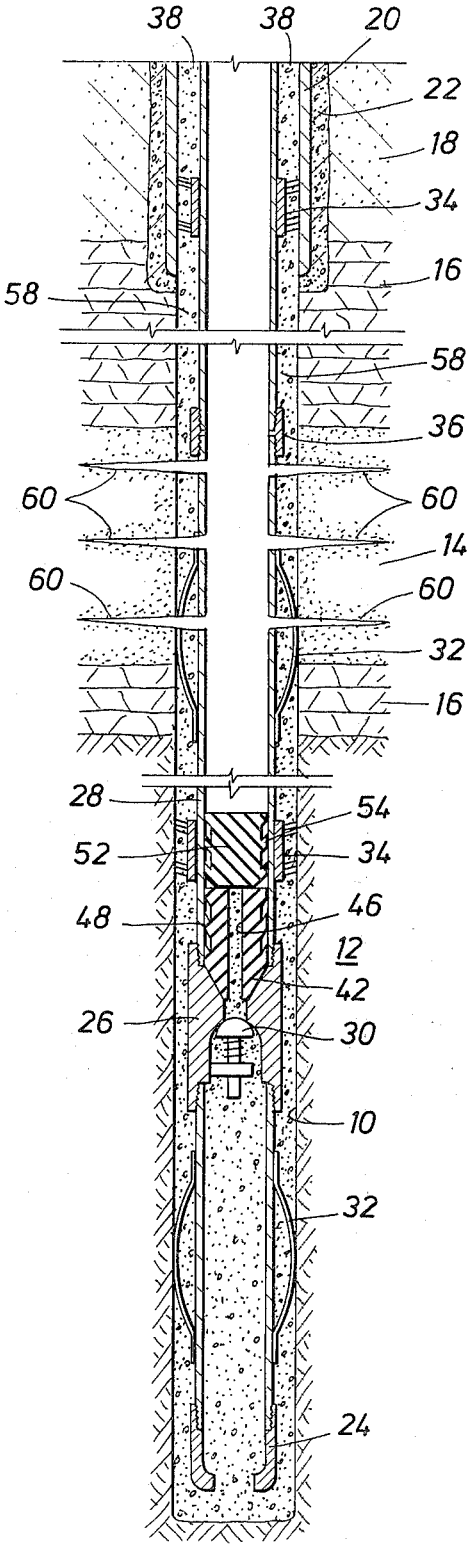
PRIOR ART FIG. 1D

FIG. 1D illustrates the method used to produce hydrocarbon fluids from the well. After the cement sheath 58 has reached its final set the casing string and the cement sheath 58 are perforated adjacent hydrocarbon producing formation 14 using well known methods. This creates a plurality of perforations 60 through which hydrocarbon fluids may flow into the casing string and upwardly to the surface. Ideally, these hydrocarbon fluids may flow only into the well and are prevented by cement sheath 58 from communicating with any of the other formations penetrated by the well.

Unfortunately, this ideal is often not achieved. A significant number of wells exhibit fluid flow through the cemented annulus a short time after the cementing is completed. Fluids from one producing formation may flow to another producing formation, to fresh water sands, or to the surface. This is especially true in deep well completions across relatively high pressure gas producing formations. This phenomenon, known as annular gas flow or annular fluid flow, is a very significant problem which has remained unsolved since it was first recognized in the mid1960's. The present invention provides a solution to this longstanding problem.

It is believed that annular fluid flow occurs due to the presence of longitudinal channels in and adjacent to the cement sheath surrounding the casing. These channels provide pathways for fluid communication from one formation to another. As stated above, one theory for the presence of the longitudinal channels is that as the cement slurry cures it loses its ability to transmit full hydrostatic pressure. When the hydrostatic pressure of the cement slurry adjacent a hydrocarbon producing formation drops below the pressure of the formation fluids, the fluids will enter the cemented annulus and flow upwardly creating the channels. The present invention provides a method for maintaining the hydrostatic pressure of the cement slurry at or above the pressure of the formation fluids until the cement has acquired sufficient strength to prevent fluid entry into the wellbore. Typically, this will occur at or before the time when the cement has acquired its initial set, as hereinafter defined.

Figure 2:
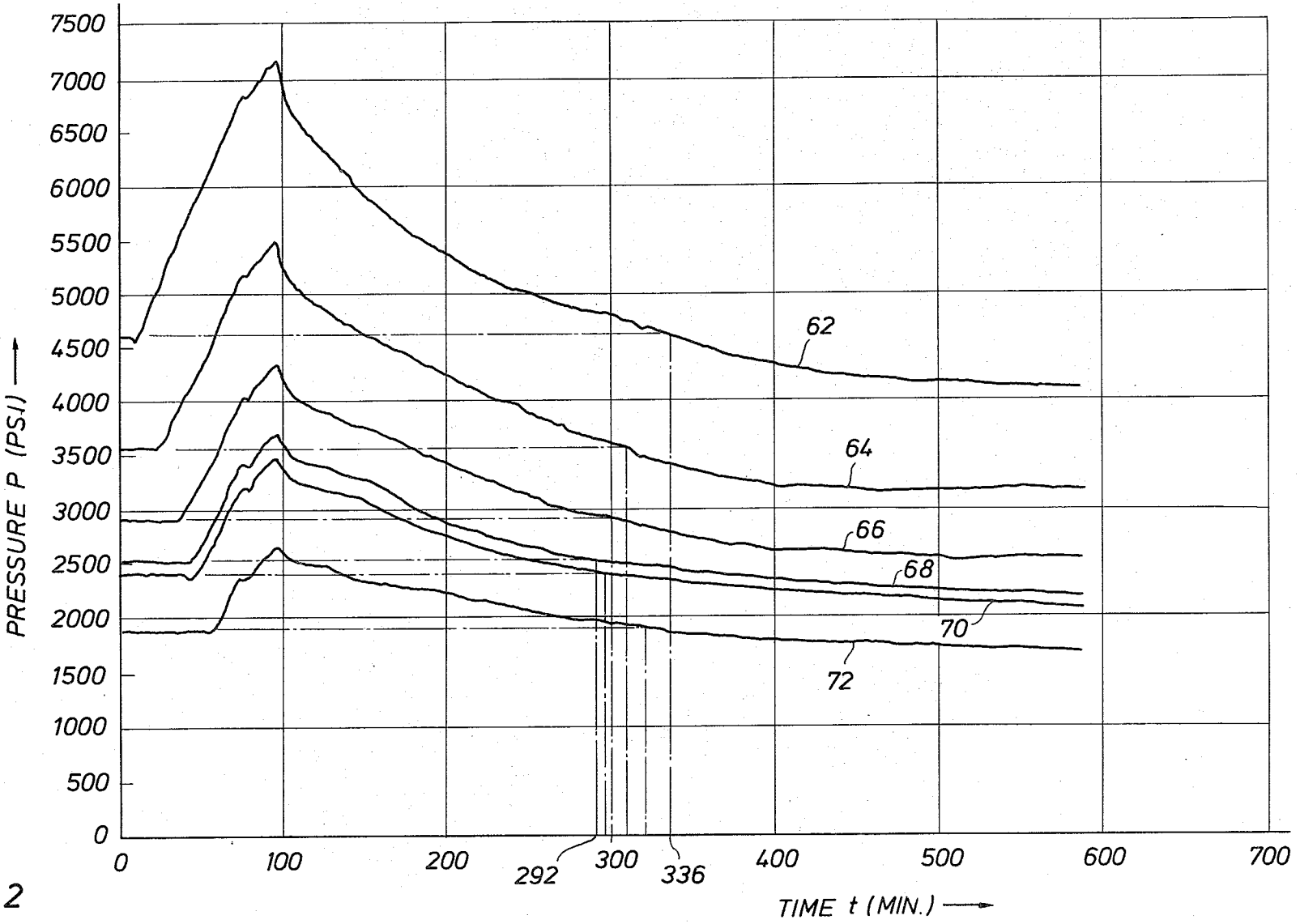
FIG. 2 is a plot of the hydrostatic pressure in a cemented annulus versus time for a variety of different depths in a production casing primary cementing job on a south Texas natural gas well.

FIG. 2 confirms the theory that a cement slurry loses its ability to transmit full hydrostatic pressure as it cures. FIG. 2 is a plot of hydrostatic pressure in a cemented annulus versus time for a variety of different depths. The data were obtained during a production casing cementing job in a natural gas well located in south Texas. Pressure sensors were attached to the outside of a $2\frac{7}{8}''$ casing string as it was being inserted into the wellbore and the pressure was monitored throughout the cementing operation. The depths of the various sensors below the well surface were as follows:

Sensor 62—8754 feet
Sensor 64—6909 feet
Sensor 66—5488 feet
Sensor 68—4787 feet
Sensor 70—4632 feet
Sensor 72—3636 feet The cement slurry used was a standard casing cement having a density of 16.6 pounds per gallon. The cement slurry was introduced into the casing string at $t=0$. The pressure recorded by each sensor at $t=0$ is the hydrostatic pressure exerted on the sensor by the drilling fluid (density = 10.2 pounds per gallon) in the annulus. Approximately 12 minutes were required to pump the cement slurry down the 8900 foot casing string and up the annulus to sensor 62. The top cementing plug reached bottom at $t=98$ minutes. The cemented annulus did not extend to the surface of the well. The calculated top of the cement column in the annulus was at a depth of 3100 feet.

Immediately after the top plug reached bottom all sensors recorded a sharp reduction in hydrostatic pressure followed by a more gradual decline throughout the experiment. Assuming that the the hydrostatic pressure exerted by the drilling fluid at $t=0$ was sufficient to prevent hydrocarbon fluids from entering the wellbore, the cement column should also prevent fluid invasion so long as its pressure remains at or above the original pressure of the drilling fluid. As shown in FIG. 2, the hydrostatic pressure recorded by all sensors had declined to the original pressure of the drilling fluid at some time between $t=292$ minutes (sensor 68) and $t=336$ minutes (sensor 62). Thereafer all sensors recorded further reduction in a hydrostatic pressure. Conditions are ripe for fluid invasion and annular fluid flow whenever the hydrostatic pressure exerted by the cement slurry is below the original pressure of the drilling fluid, which is assumed to be at least equal to the pressure of the fluids in the various formations penetrated by the well.

The present invention solves this problem by providing a method for maintaining the hydrostatic pressure exerted by the cement column at or above the pressure of the formation fluids until the cement has acquired sufficient strength to prevent fluid entry into the cemented annulus. This is accomplished by vibrating the casing so as to overcome the gel strength of the cement slurry thereby allowing the slurry to transmit full hydrostatic pressure. The vibration may be either continuous or intermittent and, preferably, has a low frequency. Preferably, the vibration commences after completion of the displacement process and continues until the cement has acquired its initial set. Vibration may be terminated prior to initial set if the cement column has developed sufficient structural integrity to prevent fluid invasion. Also, the invention may include the additional step of applying pressure to the surface of the cemented annulus until the cement acquires its initial set. Application of limited surface pressure will increase the overall hydrostatic pressure of the cement column and will, in some cases, help to overcome the gel strength of the slurry. The surface pressure must be less than that required to fracture any of the formations penetrated by the wellbore below the surface casing and will usually not be more than a few hundred psi.

The term "initial set" as used herein is defined as the point at which the cement will bear, without appreciable indentation, the initial Gillmore needle. Initial set occurs substantially before the cement acquires its final set, which is defined as the point at which the cement will bear, without appreciable indentation, the final Gillmore needle. See, ASTM C 266 "Time of Setting of Hydraulic Cement by Gillmore Needles". See also, API Bulletin 10C "Oil-Well Cement Nomenclature". Typically, initial set time would be measured on a sample of the cement at the well surface which is maintained at a temperature near that expected in the well. The cement sheath surrounding the casing will acquire its initial set somewhat earlier when the downhole temperature is higher than expected.

Generally, when the cement slurry has acquired its initial set it has become non-thixotropic. At this point vibration will become ineffectual in maintaining hydrostatic pressure. However, after it has acquired its initial set the cement slurry should have developed sufficient structural integrity and sufficiently low permeability to prevent gas invasion. In some cases the cement slurry may have acquired sufficient strength to prevent fluid from entering the annulus prior to initial set.

After vibration is terminated, the cement is allowed to complete curing undisturbed. This allows a bond to form between the casing and the surrounding cement sheath, thereby firmly locking the casing in place. The casing is also held in place by the various mechanical locks provided by the protuberances discussed above.

In some cases, vibration of the entire length of casing being cemented may not be necessary. Vibration at one point along the casing will overcome the gel strength of the cement slurry adjacent that point, allowing the slurry to exert full hydrostatic pressure. This pressure is transmitted down the annulus to points which were not vibrated and may be useful in overcoming the gel strength of the slurry adjacent those points. Thus, vibration at various intervals along the length of casing being cemented may be sufficient to overcome the gel strength of the entire cement sheath. Additionally, vibration adjacent impermeable formations may not be necessary.

Figure 3:
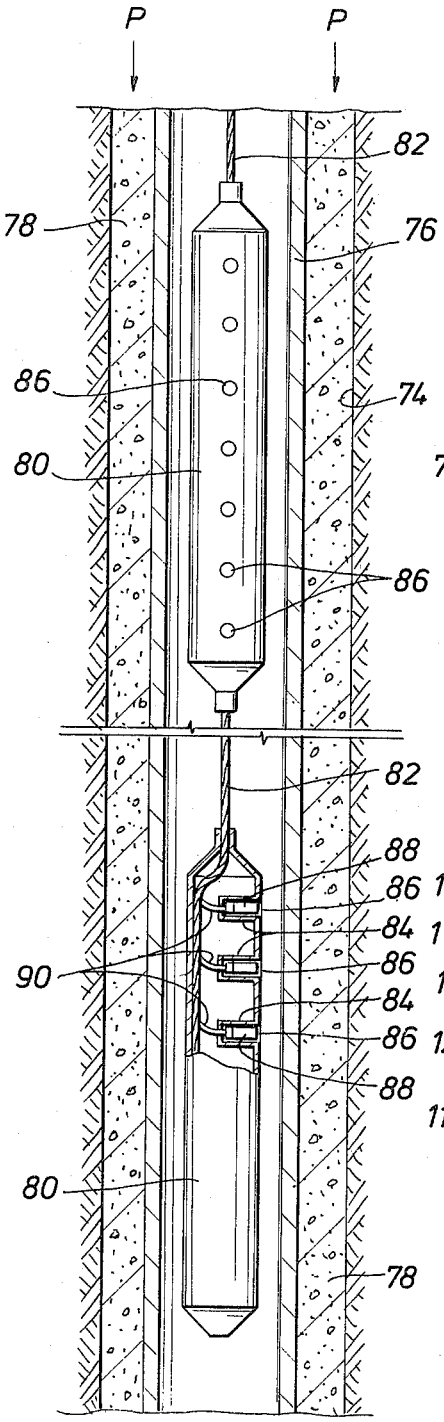
FIG. 3 is a cross-sectional elevation view illustrating one method of vibrating a cemented casing with explosive charges.
Figure 4:
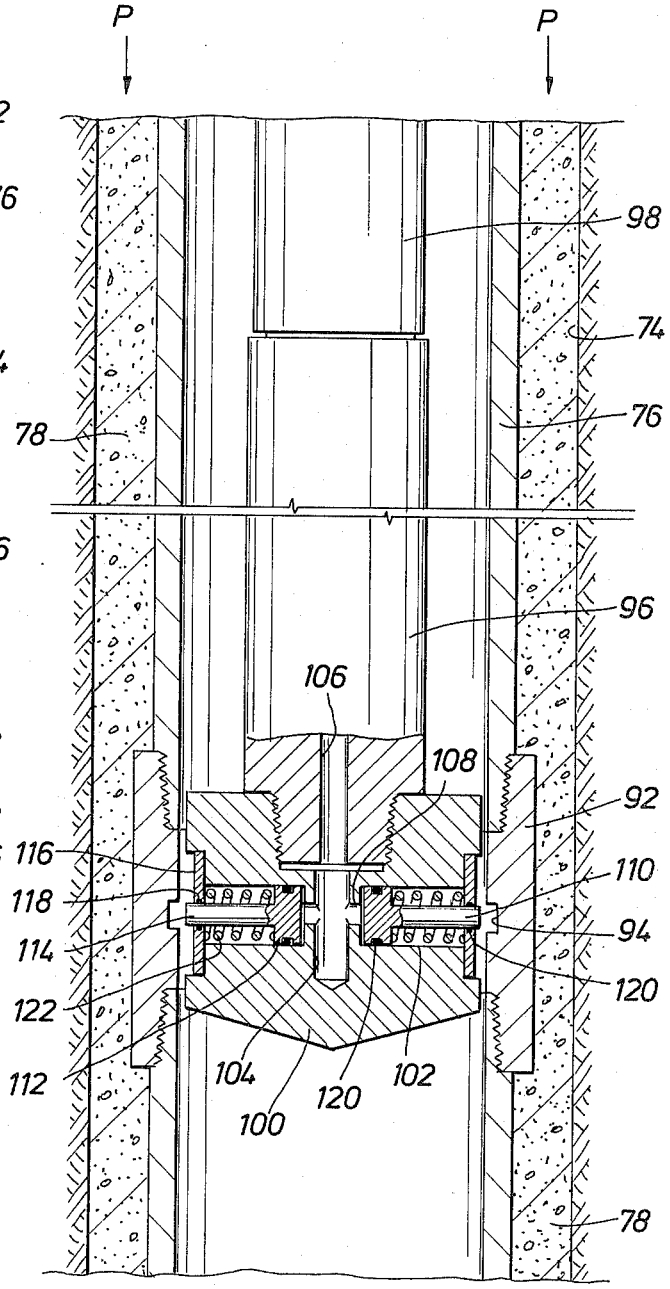
FIG. 4 is a cross-sectional elevation view illustrating a second method of vibrating a cemented casing with hydraulic jars.

FIGS. 3 and 4 illustrate two methods which may be used to vibrate the casing after the cement slurry has been pumped into the annulus. Other methods for accomplishing the desired vibration will be apparent to those skilled in the art. It will be understood that all such methods are within the scope of the present invention.

Referring to FIG. 3, there is shown a wellbore 74 having a metallic casing 76 installed therein. A cement slurry 78 has been introduced into the annulus between wellbore 74 and casing 76 in the manner previously described. It is desired to vibrate the casing 76 so as to maintain the hydrostatic pressure of the cement slurry 78 until it has acquired its initial set. The vibration may be either continuous or intermittent. If intermittent, the interval between successive vibrations is dependent on the rate at which the cement slurry 78 loses its ability to transmit full hydrostatic pressure. This may be determined by installing pressure sensors (not shown) at various depths in the annulus and monitoring the hydrostatic pressure of the cement slurry as it cures. In routine practice of the present invention pressure sensors are not necessary and the casing is vibrated at intervals or continuously until surface measurements indicate that the cement has reached initial set.

The method illustrated in FIG. 3 uses intermittent explosions to cause pressure pulses which vibrate the casing. Preferably, a slow burning explosive is used because the resulting longer explosion will maximize the low frequency portion of the vibration. As will be more fully discussed below, low frequency vibration is more effective in overcoming the gel strength of the cement slurry than high frequency vibration. One suitable explosive for use in connection with the present invention is a slow burning black powder. Other suitable explosives will be readily apparent to those skilled in the art. The size of each explosive charge should be selected so as to maximize the force of the resulting explosion without rupturing or otherwise damaging the casing.

As shown in FIG. 3, a plurality of explosive containers 80 are lowered into the casing 76 on a multiconductor cable 82. The explosive containers 80 are about the size of those used in gun perforating of production casing. FIG. 3 shows two explosive containers, the lower one in partial section and rotated 90° with respect to the upper one. A plurality of cylindrical chambers 84 are formed in a vertical row along the length of each explosive container 80. Other arrangements may also be used. Each of the chambers 84 is sealed at one end and extends through a hole in the wall of explosive container 80 at the other end. A frangible diaphragm 86 is placed in the open end of each chamber 84 so as to seal the chamber prior to the explosion.

An explosive charge and detonator 88 are placed in each chamber 84 prior to installation of frangible diaphragm 86. Typically, the charge and detonator 88 are similar to a shot gun or rifle shell, however, no projectile is included. The charges are fired electronically from the surface by means of electrical wires 90 contained in multiconductor cable 82. Each chamber 84 withiin a particular explosive container 80 is connected to a different set of wires 90 so that the chambers may be fired individually. Detonation of the charge 88 ruptures frangible diaphragm 86 and creates a pressure pulse which vibrates the casing.

The various explosive containers 80 are spaced so as to achieve vibration throughout a significant portion of the length of the cement sheath surrounding the casing being cemented. Due to the damping effect of the cement slurry and the casing, the vibratory energy caused by each explosion will attenuate after traveling through the casing for a certain distance. The distance between each of the explosive containers 80 will depend on the rate of attenuation of the vibratory energy. Generally, a spacing of approximately 500 feet between explosive containers should be satisfactory. Typically, the top charge of each explosive container 80 is fired simultaneously. After a suitable time interval during which the explosive containers 80 may be raised or lowered, the second charge of each container is fired. This process continues until all charges had been fired. In this manner the entire length of casing being cemented is vibrated several times without need for recharging the explosive containers.

FIG. 4 illustrates an alternative method for vibrating casing 76. This method uses one or more hydraulic jars, well known in the art, to achieve the desired vibration. Hydraulic jars suitable for use in connection with this method are commercially available from a number of manufacturers. One such jar is the Type Z Bowen Oil Jar manufactured by Bowen Tools, Inc.

Prior to installation of the casing string, a pipe nipple 92 having an annular groove 94 formed therein is installed between two sections of casing. The hydraulic jar 96 is lowered into the casing on a string of drill pipe 98. A locking head 100 is attached to the lower end of the hydraulic jar 96 to provide resistance to upward pull on the string of drill pipe 98. The locking head 100 has a plurality of cylinders 102 formed therein. A vertical bore 104 is formed in the center of locking head 100. The vertical bore 104 is aligned with the bore 106 through the center of hydraulic jar 96. Each of the cylinders 102 communicates with vertical bore 104 through a small hole 108. A locking pin 110 having a piston 112 formed on one end and a shank 114 formed on the other end is inserted in each cylinder 102. The diameter of the piston 112 should be slightly smaller than the diameter of cylinder 102 so that the piston will slide freely in the cylinder. Each cylinder 102 has associated therewith a retaining plate 116 having a circular hole 118 formed in its center. The retaining plates are attached to the outer surface of locking head 100 by suitable means. The diameter of circular hole 118 is slightly larger than the diameter of shank 114 so that shank 114 will slide freely in circular hole 118. A plurality of O-rings 120 of various sizes may be used to seal cylinder 102. A compression spring 122 is inserted in each cylinder 102 between piston 112 and retaining plate 116.

As the hydraulic jar 96 and locking head 100 are lowered into the well, locking pins 110 are retracted (as shown in FIG. 4) permitting unrestricted insertion. When the assembly has reached the desired depth, pressure is applied to the locking pins 110 causing them to extend and engage annular groove 94. The pressure is applied at the surface of the well and is tranmitted down the drill pipe 98 and through the various bores to the back of piston 112. Hydraulic jar 96 is then operated in the normal manner to vibrate casing 76. Generally, the hydraulic jar is operated by applying an upward force at the top of the drill string. The jar contains a piston and a mandrel separated by a hydraulic fluid. The upward force on the drill string pressurizes this fluid. The pressure is suddenly released causing the piston to strike the mandrel with great force. Releasing the upward tension resets the piston and mandrel for a second blow. Several blows can be struck per minute. Thus, the vibration caused is essentially continuous. When the vibration is completed, the pressure at the surface of the well is released. Compression springs 122 then cause the locking pins 110 to retract into locking head 100 thereby permitting free removal of the drill string 98 and the hydraulic jar 96.

As stated above, pressure P (see FIGS. 3 and 4) may be applied to the top of the annulus to aid the vibration in maintaining the hydrostatic pressure of the cement slurry. Typically, the pressure is applied after the cement slurry has been pumped into the annulus and maintained until the cement slurry acquires its initial set. Means for accomplishing this are well known in the applicable art.

Other methods of vibrating the casing may be used. For example, explosive charges similar to those described above may be used to propel a projectile against the wall of the casing. This may be done sequentially or simultaneously at different depths in the wellbore. Alternatively, the energy to create pressure pulses in the casing or to propel projectiles against the casing may be supplied by explosion of a hydrocarbon gas and oxygen. Such techniques are used in geophysics for creating sonic pulses. Such explosions may occur at the surface or downhole. The hydraulic jars described above may be attached to and operated by a wireline. This would require that a type of locking head different than that described above be designed. For example, the wireline could be an electric wireline and the locking head could be electrically actuated. Another method of vibrating the casing would be to attach an electrical, mechanical or hydraulic vibrator, well known in the art, to the casing at the surface of the well. This may be especially useful when the casing is relatively short. However, this method may be limited by the physical size of the system when the casing string is several thousand feet long. In such case, vibration applied at the top only would be totally damped out before reaching the bottom of the casing string, thereby leaving the bottom of the casing undisturbed. This problem may require that one or more vibrators be lowered into the casing on a wire line so that the vibration may be induced downhole. The vibrators, either at the surface or downhole, may be set to apply an optimum frequency range to the casing and the vibration created may be either continuous or intermittent. Vibrating elements may also be driven by fluid pumped down a drill string. Additionally, a number of devices may be developed to hammer on the casing, either at the surface or downhole. Such devices may be operated electrically or hydraulically.

During early stages of the curing process it may be possible to overcome the gel strength of the cement slurry thereby allowing the slurry to transmit full hydrostatic pressure by alternately raising and lowering the entire casing string a small distance. This is done by allowing the casing string to remain suspended from the derrick and using the derrick's hoisting system to raise and lower the casing string. This alternate raising and lowering of the entire casing string may be done intermittently or continuously. The top of the casing string must be raised a sufficient amount to cause a displacement of the bottom of the string taking into account the elasticity of the casing. The vibration induced in the cement slurry results from a variety of factors such as flexure of the casing string in the irregular borehole, flow of the cement slurry past the various protuberances on the casing string, or longitudinal vibration of the casing caused by acceleration or deceleration of the casing. This movement must be terminated when the force required to support the casing during downward movement approaches zero. At this point the gel strength of the slurry has increased to the point where the casing is nearly self-supporting. Thereafter, other methods of vibration, such as those described above, may be employed to maintain the hydrostatic pressure of the cement slurry.

EXPERIMENTAL VERIFICATION

Figure 5:
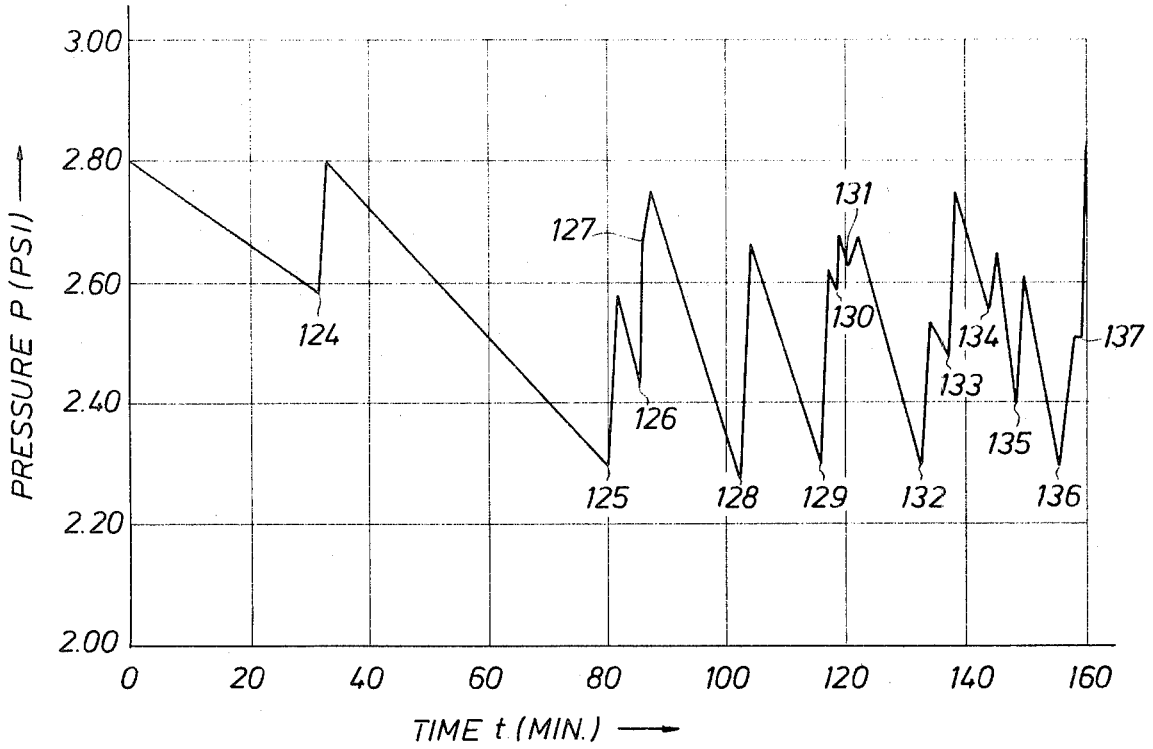
FIG. 5 is a plot of hydrostatic pressure versus time for a first laboratory experiment which illustrates that hammer strikes on a casing are effective in maintaining hydrostatic pressure.
Figure 5:
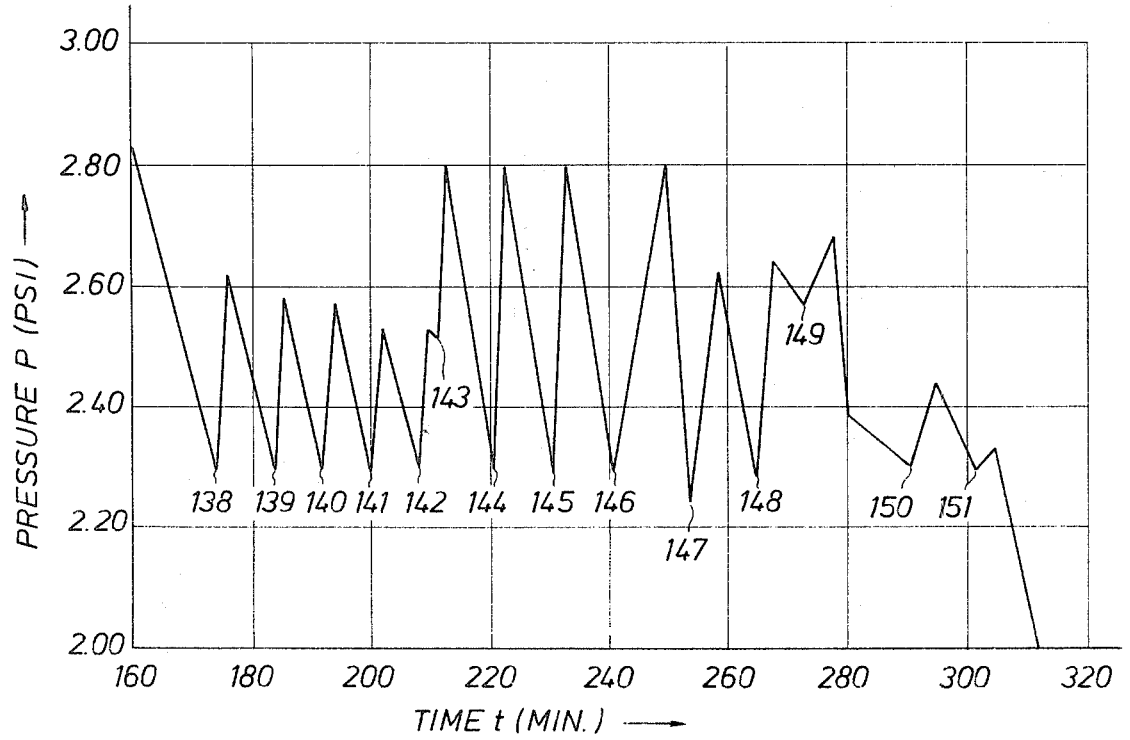
Figure 6:
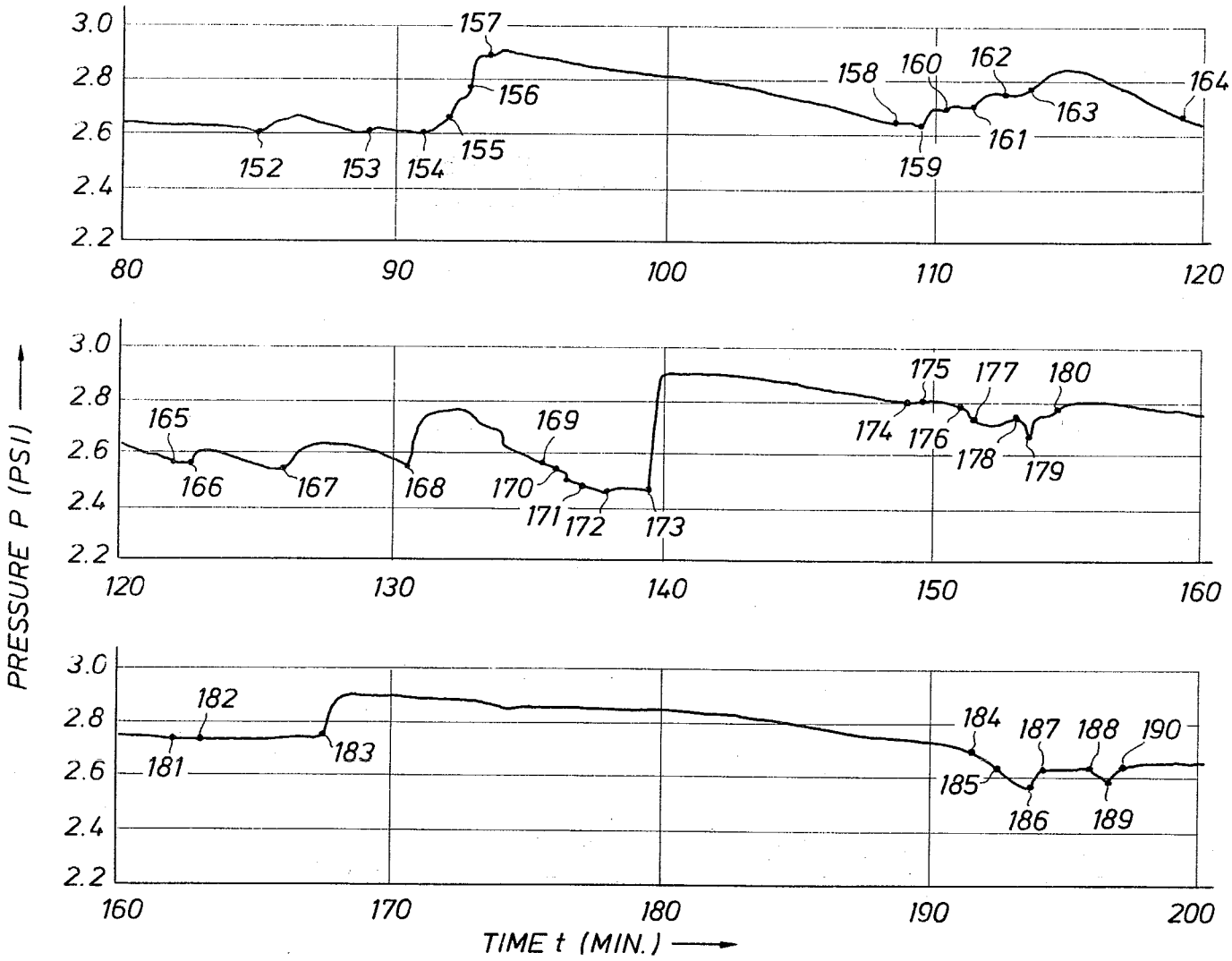
FIG. 6 is a plot of hydrostatic pressure versus time for a second laboratory experiment which illustrates that vibrations having a low frequency are more effective in maintaining hydrostatic pressure than are high frequency vibrations.
Figure 6:
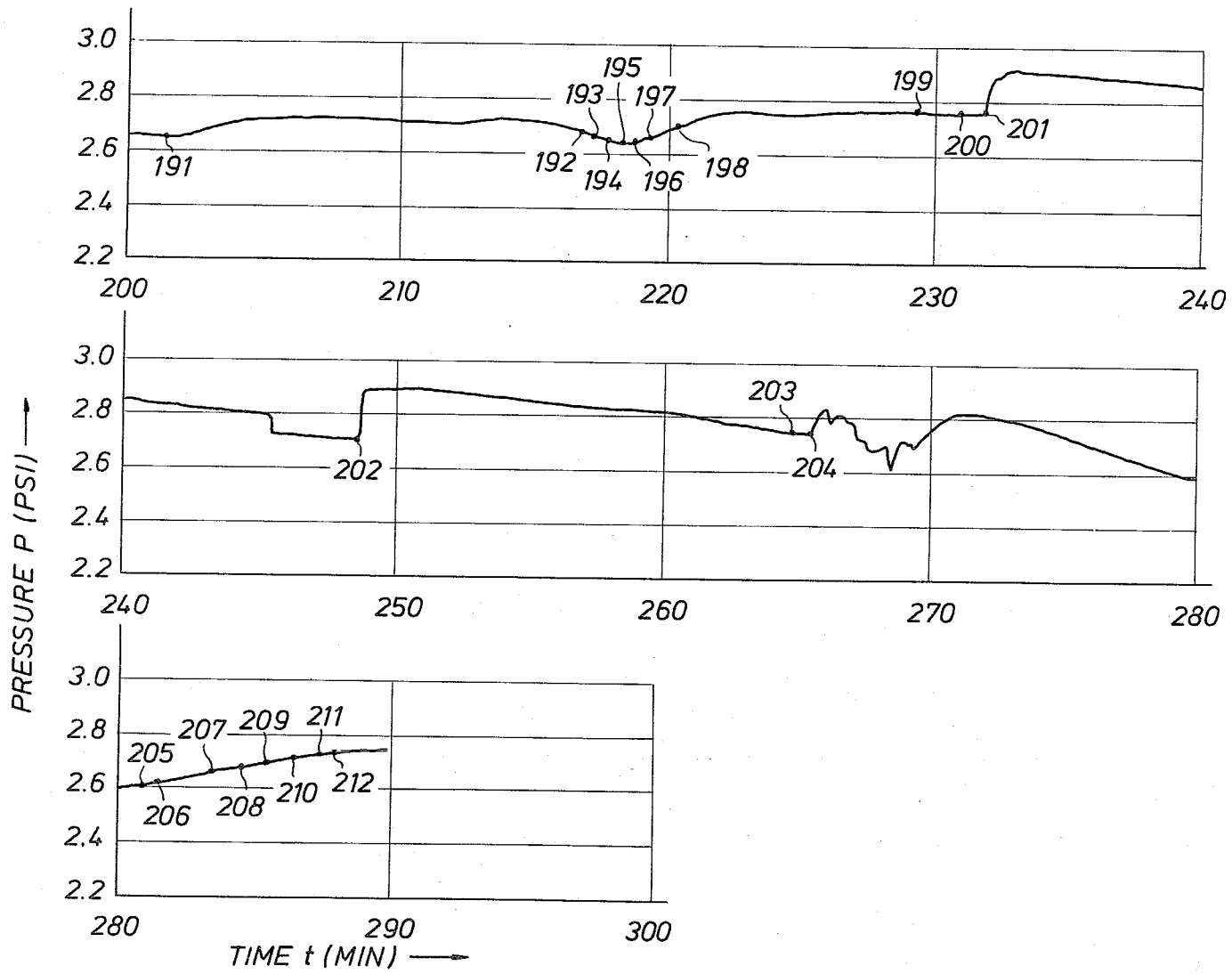

FIGS. 5 and 6 illustrate the results of two laboratory experiments which demonstrate that vibration can be used to maintain the hydrostatic pressure in a cement column while it cures.

FIG. 5 is a plot of hydrostatic pressure versus time for the following experiment. A four foot high section of four inch inside diameter steel casing was closed at the bottom by welding a plate to the end of the casing. A pressure transducer was mounted in the casing about four inches from the bottom and an accelerometer was mounted to the outside of the casing. The casing was filled to a depth of about 42 inches with an API Class H Portland cement slurry having a water concentration of 38 parts per 100 parts of cement. Immediately after the cement slurry was introduced into the casing, the pressure transducer recorded a pressure of 2.80 psi. The pressure began declining with time as shown in FIG. 5. The pressure was allowed to decline to 2.58 psi at which time (t=32 minutes) the casing was struck with a metal hammer at a position about three feet from the bottom. It was found that the pressure in the cement column rapidly rose to near the original pressure after the hammer blow to the casing. This process was repeated for a period of approximately five hours as illustrated in FIG. 5. Each of the hammer strikes is indicated by one of the numbered nodes in FIG. 5. Nodes 124 through 142 indicate single hammer strikes. Thereafter multiple strikes were necessary to maintain the hydrostatic pressure of the cement column. For example, node 146 represents approximately 200 hammer strikes at various points around the outside surface of the casing. After 280 minutes the cement was hard, but not completely set.

The horizontal acceleration of the casing was monitored using the accelerometer. The results show that a relatively high horizontal acceleration was introduced into the casing by the hammer strikes. For example, the maximum horizontal acceleration caused by the fifth hammer strike (node 128) was about 60 g's. A spectral analysis of the hammer strikes showed that a broad range of frequencies was present in the resulting vibration. There appeared to be a higher intensity of vibration at approximately 100 cycles per second; however, significant amounts of energy at frequencies up to 5000 cycles per second were present.

FIG. 6 illustrates the results of a second laboratory experiment which was conducted to determine the effect of varying both frequency and amplitude of the vibration. A six foot long, one and one-half inch outside diameter aluminum tube was positioned vertically in the center of a four foot high vertical section of four inch inside diameter steel casing. A steel plate was welded on the bottom of the casing and the aluminum tube extended through a hole in the steel plate and downward for a distance of approximately one foot below the casing where the aluminum tube was attached to a commercial electrical vibrator. A sponge rubber gasket was used to prevent leakage of the cement slurry where the aluminum tube went through the steel plate. A pressure transducer was installed in the wall of the casing approximately four inches from the bottom of the casing. The annulus between the tube and the casing was filled to a depth of approximatey 39" above the pressure transducer with an API Class H cement slurry having a water concentration of 38 parts per 100 parts of cement. An accelerometer was attached to the top of the aluminum tube so as to measure the vertical acceleration of the vibration. The vibrator had the ability to vary both frequency and amplitude of the vibration. Amplitude was controlled by the output voltage of the vibrator. Acceleration was measured in g's. The magnitude of the amplitude was then calculated from the following formula:

$$A=980N/(2\pi f)^2$$

where A=amplitude in centimeters, N=acceleration in g's (g=980 cm/sec$^2$) and f=frequency in cycles per second. This may be reduced to $$A=24.82\times 10^4(N)/f^2$$

where A=amplitude in microns. (1 micron=$10^{-4}$ centimeters)

The effect of vibration on hydrostatic pressure was monitored for a variety of frequencies and accelerations. The results are shown graphically in FIG. 6. The various frequencies and accelerations tested are tabulated below. Each of the vibrations continued for approximately 30 seconds. The maximum hydrostatic pressure at time t=0 was 2.91 psi.

| Node | Time (minutes) | Frequency (cycles/second) | Acceleration (g's) | Amplitude (microns) |
|---|---|---|---|---|
| 152 | 85 | 1000 | 6.49 | 1.61 |
| 153 | 89 | 900 | 3.46 | 1.06 |
| 154 | 91 | 20 | 0.17 | 107.45 |
| 155 | 92 | 20 | 0.22 | 134.31 |
| 156 | 93 | 20 | 0.61 | 376.06 |
| 157 | 93.5 | 20 | 1.19 | 738.69 |
| 158 | 108.5 | 40 | 0.43 | 67.15 |
| 159 | 109.5 | 40 | 0.87 | 134.31 |
| 160 | 110.5 | 40 | 1.30 | 201.46 |
| 161 | 111.5 | 40 | 1.73 | 268.61 |
| 162 | 112.5 | 40 | 2.16 | 335.77 |
| 163 | 113.5 | 40 | 3.46 | 537.23 |
| 164 | 119 | 100 | 0.13 | 3.22 |
| 165 | 122 | 100 | 1.73 | 42.98 |
| 166 | 122.5 | 100 | 3.46 | 85.96 |
| 167 | 126 | 900 | 34.63 | 10.61 |
| 168 | 130.5 | 870 | 95.24 | 31.23 |
| 169 | 135.5 | 500 | 4.33 | 4.30 |
| 170 | 136 | 500 | 6.49 | 6.45 |
| 171 | 137 | 200 | 4.33 | 28.86 |
| 172 | 138 | 100 | 4.33 | 107.45 |
| 173 | 139.5 | 20 | 2.16 | 1343.00 |
| 174 | 149 | 200 | 1.73 | 10.74 |
| 175 | 149.5 | 200 | 3.46 | 21.49 |
| 176 | 151 | 100 | 2.60 | 64.47 |
| 177 | 151.5 | 100 | 3.46 | 85.96 |
| 178 | 153 | 40 | 1.73 | 268.61 |
| 179 | 153.5 | 40 | 3.46 | 537.23 |
| 180 | 154.5 | 40 | 3.90 | 604.38 |
| 181 | 162 | 800 | 6.06 | 2.35 |
| 182 | 163 | 800 | 12.99 | 5.04 |
| 183 | 167.5 | 20 | 1.73 | 1074.46 |
| 184 | 191.5 | 40 | 0.43 | 67.15 |
| 185 | 192.5 | 40 | 1.73 | 268.61 |
| 186 | 193.5 | 40 | 2.60 | 402.92 |
| 187 | 194 | 40 | 3.90 | 604.38 |
| 188 | 196 | 30 | 1.30 | 358.15 |
| 189 | 196.5 | 30 | 1.73 | 477.54 |
| 190 | 197 | 30 | 2.16 | 596.92 |
| 191 | 201.5 | 20 | 1.19 | 738.69 |
| 192 | 217 | 10 | 0.43 | 1074.46 |
| 193 | 217.5 | 10 | 0.17 | 429.78 |
| 194 | 218 | 10 | 0.52 | 1289.35 |
| 195 | 218.5 | 10 | 0.87 | 2148.92 |
| 196 | 219 | 20 | 1.08 | 671.54 |
| 197 | 219.5 | 20 | 1.52 | 940.15 |
| 198 | 220.5 | 20 | 2.38 | 1477.38 |
| 199 | 229.5 | 40 | 0.43 | 67.15 |
| 200 | 231 | 40 | 3.90 | 604.38 |
| 201 | 232 | 20 | 4.33 | 2686.15 |

-continued

| Node | Time (minutes) | Frequency (cycles/second) | Acceleration (g's) | Amplitude (microns) |
|---|---|---|---|---|
| 202 | 249 | 20 | 1.73 | 1074.46 |
| 203 | 265 | 20 | 0.43 | 268.61 |
| 204 | 265.5 | 20 | 0.87 | 537.23 |
| 205 | 281 | 20 | 0.43 | 268.61 |
| 206 | 281.5 | 20 | 0.87 | 537.23 |
| 207 | 283.5 | 20 | 1.30 | 805.84 |
| 208 | 284.5 | 20 | 1.73 | 1074.46 |
| 209 | 285.5 | 20 | 2.60 | 1611.69 |
| 210 | 286.5 | 20 | 3.46 | 2148.92 |
| 211 | 287.5 | 40 | 3.46 | 537.23 |
| 212 | 288 | 40 | 3.90 | 604.38 |

At time t=300 minutes, the cement was hard, but not completely set.

A comparison of FIG. 6 and the foregoing table indicates that the best results were obtained at a frequency of 20 cycles per second. See, for example, nodes 154–157, 173, 183, 201 and 202. At each of these nodes a 20 cycle per second vibration with a relatively large amplitude had a dramatic effect on the hydrostatic pressure in the cemented annulus. Thus, 20 cycles per second is clearly the optimum frequency for maintaining the hydrostatic pressure in the experimental set-up. The optimum frequency may vary somewhat in a well; however, low frequencies (e.g. less than about 100 cycles per second) are clearly preferable to high frequencies. This is especially true as the slurry nears its initial set. See, for example, nodes 181 and 182 where a frequency of 800 cycles per second had no effect on the hydrostatic pressure in the cemented annulus. Apparently this is caused by the low amplitude associated with high frequency vibration. Even the resonant frequency of the system was not as effective as low frequency vibration. The resonant frequency was found to be 870 cycles per second (node 168). FIG. 6 shows a substantial increase in pressure at node 168 when the acceleration was 96.24 g's; however, the result at node 173 (20 cycles per second) nine minutes later was better when the acceleration was only 2.16 g's. Thus, considerably less energy was required to produce a positive response at low frequencies than at high frequencies.

Two primary conclusions may be drawn from the above experiments.

1. Both horizontal or transverse vibration (first experiment) and vertical or longitudinal vibration (second experiment) are useful in maintaining hydrostatic pressure in a cemented annulus.
2. Low frequency, high amplitude vibration is preferable to high frequency, low amplitude vibration, at least when the vibration is vertical. However, high frequency vibration may also be beneficial.

The method of the present invention and the best mode contemplated for practicing the invention have been described. It should be understood that the invention is not to be unduly limited to the foregoing which has been set forth for illustrative purposes. Various modifications and alterations of the invention will be apparent to those skilled in the art without departing from the true scope of the invention defined in the following claims.

What I claim is:

1. A method for cementing a well casing in a well which passes through at least one subterranean formation containing pressurized formation fluids, said well casing being inserted in said well so as to define an annulus between said well casing and the wall of said well, said method comprising the steps of:

introducing a cement slurry having a hydrostatic pressure at least equal to the pressure of said pressurized formation fluids into said annulus; and continuously maintaining said hydrostatic pressure of said cement slurry at least equal to the pressure of said pressurized formation fluids until said cement slurry has developed sufficient strength to prevent said pressurized formation fluids from entering said annulus, said hydrostatic pressure being maintained by causing vibration in said well casing.

2. The method of claim 1, said method further comprising the step of applying pressure at the surface of said annulus, said pressure being applied after said cement slurry has been introduced into said annulus and being maintained during said vibration.

3. The method of claim 1 or claim 2 wherein said vibration is continuous.

4. The method of claim 1 or claim 2 wherein said vibration is intermittent.

5. The method of claim 1 or claim 2 wherein at least a portion of said vibration has a frequency less than about 100 cycles per second.

6. The method of claim 1 or claim 2 wherein at least a portion of said vibration has a frequency less than about 50 cycles per second.

7. The method of claim 1 or claim 2 wherein said vibration is caused by periodic detonation of explosive charges, said explosive charges being located at various depths in said well casing.

8. The method of claim 7 wherein said explosive charges are a relatively slow-burning explosive.

9. The method of claim 7 wherein said explosive charges are a mixture of a hydrocarbon gas and oxygen.

10. The method of claim 7 wherein said explosive charges are used to propel a projectile against the wall of said well casing.

11. The method of claim 1 or claim 2 wherein said vibration is caused by repeated impacts of a hydraulic jar.

12. The method of claim 11 wherein said hydraulic jar is attached to and lowered into said well casing by a string of drill pipe so as to releasibly engage said well casing and wherein said hydraulic jar is actuated by sequentially applying and releasing upward tension to said drill pipe.

13. The method of claim 11 wherein said hydraulic jar is attached to and lowered into said well casing by a wireline so as to releasibly engage said well casing and wherein said hydraulic jar is actuated by sequentially applying and releasing upward tension to said wireline.

14. The method of claim 1 or claim 2 wherein said vibration is caused by a vibrator attached to and lowered into said well casing by a wireline, said vibrator being powered by electrical energy supplied from the surface through an electrical conductor in said wireline.

15. The method of claim 1 or claim 2 wherein said vibration is caused by a vibrator attached to and lowered into said well casing by a string of drill pipe and wherein said vibrator is driven by a fluid which is pumped down the string of drill pipe and which returns to the surface through said well casing.

16. The method of claim 1 or claim 2 wherein said vibration is caused by alternately raising and lowering the entire casing string a small amount, said raising and lowering being continued until the force required to support said casing during lowering approaches zero.

17. A method for cementing a well casing in a well which passes through at least one subterranean formation containing pressurized fluids, said method comprising:

inserting said well casing into said well so as to define an annulus between said well casing and the wall of said well;

introducing a cement slurry capable of exerting a hydrostatic pressure into said annulus;

vibrating said well casing so as to maintain the hydrostatic pressure of said cement slurry at least equal to the pressure of said pressurized fluids, said vibrations being transmitted by said casing into said cement slurry; and continuing said vibration at least until said cement slurry has acquired sufficient strength to prevent said pressurized fluids from entering said annulus.

18. The method of claim 17, said method further comprising the steps of:

terminating said vibration when said cement slurry has acquired sufficient strength to prevent said pressurized fluids from entering said annulus; and permitting said cement slurry to complete curing.

19. The method of claim 17, said method further comprising the step of applying pressure at the surface of said annulus, said pressure being applied after said cement slurry has been introduced into said annulus and being maintained during said vibration.

20. The method of claim 17 wherein said vibration is continuous.

21. The method of claim 17 wherein said vibration is intermittent.

22. The method of claim 17 wherein at least a portion of said vibration has a frequency less than about 100 cycles per second.

23. The method of claim 17 wherein at least a portion of said vibration has a frequency less than about 50 cycles per second.

24. A method for preventing pressurized formation fluids from entering the annulus surrounding a well casing installed in a well which passes through at least one subterranean formation containing pressurized formation fluids, said annulus having a cement slurry capable of exerting a hydrostatic pressure contained therein, said method comprising vibrating said well casing while said cement slurry is curing, said vibration transmitted by said well casing into said cement slurry and capable of maintaining the hydrostatic pressure exerted by said cement slurry at least equal to the pressure of said pressurized formation fluids.

25. The method of claim 24 wherein said well casing is vibrated until said cement slurry has acquired sufficient strength to prevent said pressurized formation fluids from entering said annulus.

26. The method of claim 24 wherein said well casing is vibrated until said cement slurry has acquired its initial set.

27. The method of claim 24 wherein said well casing is vibrated until said cement slurry has become non-thixotropic.

28. The method of claim 24 wherein said method further comprises the step of applying pressure at the surface of said annulus, said pressure being applied after said cement slurry has been introduced into said annulus and being maintained until said cement slurry has acquired its initial set.

* * * * *